United States Patent [19]

Berthold et al.

[11] Patent Number: 4,905,626

[45] Date of Patent: Mar. 6, 1990

[54] WIRE INTAKE DEVICE FOR A WIRE ENAMELING MACHINE

[75] Inventors: Herbert Berthold, Deutschlandsberg; Hans-Peter Pichler, Neufeldweg, both of Austria

[73] Assignee: Mag Maschinen Und Apparatebau Gesellschaft M.B.H., Graz, Austria

[21] Appl. No.: 235,023

[22] Filed: Aug. 22, 1988

[30] Foreign Application Priority Data

Aug. 21, 1987 [DE] Fed. Rep. of Germany ..... 3727976

[51] Int. Cl.[4] ..... H01B 13/16; B05D 7/20; F27B 19/04

[52] U.S. Cl. ..... 118/419; 118/428; 242/47.08; 242/157.1

[58] Field of Search ..... 118/428, 68, 58, 117, 118/208, 234, 325, 420, 307, 123; 242/47.08 X, 47.11, 47.12, 47.13, 157.1 X

[56] References Cited

U.S. PATENT DOCUMENTS

| | | | |
|---|---|---|---|
| 1,028,827 | 6/1912 | Nehring | 118/420 |
| 1,303,070 | 5/1919 | Kochendorfer et al. | 118/420 |
| 2,575,981 | 11/1951 | Smith | 118/420 |
| 2,685,878 | 5/1959 | Kocay et al. | 118/325 |
| 3,716,023 | 2/1973 | Walukonis et al. | 118/420 |
| 3,919,069 | 11/1975 | Ascher | 118/420 |
| 4,577,810 | 3/1986 | Sandvik | 242/157.1 |

FOREIGN PATENT DOCUMENTS

| | | | |
|---|---|---|---|
| 610614 | 12/1960 | Canada | 118/420 |
| 3118830 | 5/1983 | Fed. Rep. of Germany . | |
| 0597762 | 3/1978 | U.S.S.R. | 118/420 |

*Primary Examiner*—Willard Hoag

*Attorney, Agent, or Firm*—Pearne, Gordon, McCoy & Granger

[57] ABSTRACT

An automatically operated wire intake device is proposed for a wire enameling machine. In this machine the wire that is to be enameled is wound a number of times around roller blocks that stand at some distance from one another. The wire runs through the processing stations of the wire enameling machine a number of times by rotating around these roller blocks. With regards to the wire intake device, a displaceable slide block is positioned on a rotating transfer bar onto which the end of the wire is fastened, and which a pilot carries. Upon each rotation of the transfer bar this pilot comes into contact with a point arrangement which displaces the slide block by one "stage" to the side at each rotation, which displacement corresponds to the spacing of neighboring guide channels on the roller blocks.

14 Claims, 2 Drawing Sheets

WIRE INTAKE DEVICE FOR A WIRE ENAMELING MACHINE

DESCRIPTION

This invention concerns a wire intake device designed especially for a wire enameling machine, in which the wire to be coated is continuously pulled by an unwinding mechanism and wound several times around a minimum of two roller blocks that stand at a distance from one another parallel to the axis. The wire passes through the processing stations of the wire enameling machine by rotating around these roller blocks a number of times, and is finally led away from the roller block structure.

A wire enameling machine of the type referred to above is described, for example, in publication DE-PS 31 18 830. In this document a number of devices appear along the transport direction of the wire, one behind the other: an enamel coating device for the application of enamel onto wire; a stove for baking enamel onto wire; as well as a drying or hardening device which dries and thereby hardens the enamel. The wire that is to be coated with enamel is wound off of wire-wound coils by means of a wire intake device. It is then wound a number of times around two deflection rollers which lie across from one another at some distance, so that the wire passes through each of the processing stations on more than one occasion. The required enamel layer thickness is thus gradually built up, and in the course of this process the finished enameled wire, newly provided with an enamel coating of the required thickness, is finally led away from the deflection rollers and wound onto an enameled wire take-up device.

Either a single wire or—by using an alternate method of operation—a number of parallel wires can be coated with enamel in the wire enameling machine, in connection with which latter case, two or more wires lying parallel beside one another are led to and wound around the deflection rollers.

When one employs any of the wire enameling machines currently known, one must hand feed the end of the wire (or ends of wires) through the processing stations and wind it (or them) around the roller blocks at the start of each coating process. This represents a laborious and time-consuming procedure, especially when one considers that the roller blocks generally lie approximately ten to fifteen meters apart from one another, and that the hand feeding of wire cannot be accomplished by a single person. This is particularly the case when the wire enameling machine has a vertically aligned design—that is, the roller blocks are arranged so as to lie vertically above one another. Furthermore, the hand feeding of wires is plagued by numerous sources of error. In particular there exists the danger that the channel of the roller block allocated to the present winding will not be chosen, due to error. Also, the wire can bore a hole in itself if it is inserted improperly. Additional problems also arise from hand-feeding, for in certain processing stations—such as, for example, the stove and the wire cooling device—the act of wire feeding is invisible, which makes the proper threading of wire that much more difficult.

It is clear that the difficulties enumerated above are heightened, and the possible sources of error multiplied considerably, when, instead of a single wire, a number of parallel wires must be drawn into the machine. In the process of such hand feeding—with multiple wires in particular—an occasional mix up among the guide channels of the roller blocks presently allocated to the wire cannot, in practice, be avoided.

Thus, a specific problem lies at the root of this invention and has given rise to it, namely: how to feed wires into a wire enameling machine in such a way as to simplify the process and to eliminate, as far as possible, the various sources of error attendant thereon.

This task is essentially solved by the invention, in that it provides an automatically operated wire feeding device. In connection with this, the wire feeding device possesses a transfer bar which rotates around the roller blocks, parallel to their axis; a shifting slide block is provided on the transfer bar, in an axial direction; the slide block possesses a device to secure at least one wire end; the slide block carries a guide element diagonal to its movement plane, and in connection with which a stationary point arrangement is provided in the movement path of the guide element, which point arrangement displaces the guide element in an axial direction by one "stage" upon each rotation around the roller block structure. This displacement in turn corresponds to the axial displacement of two neighboring coils of the wire on the roller block structure.

In accordance with the invention, the automatically operated wire intake device fastens the end of the wire onto the slide block, by doing which the slide block finds itself in the starting position—facing in an axial direction—at one end of its shifting path; which position corresponds to the axial position of the first guide channel of the roller blocks, which is to be laid with wire. Once the end of the wire is secured onto the slide block the transfer bar is set in rotation. As a result the slide block, pulling the wire behind itself, lays the wire in what, at the moment, is the first channel of the roller blocks. As soon as the transfer bar has made one complete rotation it reaches the point arrangement, so that the guide element of the slide block comes into contact with this point arrangement. By this means the slide block is displaced a certain distance across the guide surface of the point arrangement—which runs obliquely to the direction of the wire, and in an axial direction relative to the transfer bar—which amount corresponds to the distance of two guide channels of the roller blocks. Upon the next rotation of the transfer bar, the wire is thence laid into the second channels, which are adjacent to the first channels of the roller block. The procedure described above repeats itself until the wire is coiled completely and in an orderly fashion onto the roller blocks. Finally, the rotation of the transfer bar is stopped, the end of the wire is released from the slide block and led to the enameled wire winding device.

The preceding operations concern themselves with the intake of a single wire. If several wires are to be drawn in simultaneously, in the shape of a harp, then the procedure will occur in a corresponding manner. The ends of the various wires are fastened onto the slide block with the spacing previously described, and in this case the point arrangement is laid out in such a way that upon each passage the slide block is displaced by a multiple of the distance of the neighboring guide channels which corresponds to the number of wires which are to be simultaneously drawn in.

The automatically operated wire intake device described in this invention consequently achieves a quick, simple, dependable and error-free intake of not only one wire, but of several wires simultaneously as well.

With regards to the movement of the transfer bar, the preferred further development of this invention provides for two continuous carriers which rotate around the roller blocks—arranged on both sides of the winding area of the wire, or wires—and which carry the ends of the transfer bar. These carriers can, for example, be formed of chains, cables or something similar. Preferably, however, the carriers are manufactured from heat-proof, punched tape-suitable materials.

According to the way that the carriers rotate around the roller blocks, they can be propelled by means of the same driving mechanism as the roller blocks, so that a separate driving mechanism is unnecessary.

In the preferred further development of the invention the carriers rotate on rollers, which are co-axial with the roller blocks and which can be coupled with these, so that a roller block or the rollers that convey the carriers can be driven separately from one another.

In consequence of a further advantageous characteristic of the invention, the tape-like carriers exhibit perforations which, together with projecting parts built into the roller blocks, work in a propellant-like fashion; as a result, a particularly secure, interlocking contact of the tape carrier with its transport device is achieved and, as a further consequence, a particularly secure and reliable forward movement of the transfer bar, which draws in the wire to be fed, is obtained.

It may also be useful to fasten the transfer bar onto the carrier in a detachable manner, so that following the intake of wire the transfer bar can be separated from the carrying straps, thus allowing the carrying straps to rotate together with the wire during the operation of the wire enameling machine, without having to disengage them from the roller blocks.

Furthermore, it may be useful to fasten the slide blocks onto the transfer bars in a detachable manner, so that this may be easily exchanged if, for example, instead of a single wire a number of wires are to be drawn in simultaneously, and the slide block must therefore utilize several fastening devices for the ends of the wires.

For the same reason, the stationary point arrangement is also structured so as to be exchangeable, because the point arrangement must exhibit a variable quantity in displacement, depending upon the number of wires to be simultaneously drawn in. To be sure, it would be conceivable not to exchange the point arrangement in this case, but rather simply to design the guide surface of the point arrangement so that it is movable and, in particular, so that it can be swiveled.

In one variant of the invention, the point arrangement exhibits a number—corresponding to the number of coils of the wire on the roller block structure—of guide surfaces that come into contact with the guide element of the slide block, which guide surfaces are arranged lying beside one another in an axial direction, and are inclined facing the center plane that connects the roller blocks. In doing so the guide surfaces define, in the guide element's direction of movement, a self-expanding funnel-shaped entry area for the guide element, and an exit area whose width corresponds to the width of the guide element. By this means a secure entry of the guide element into the point is insured on the one side, without having to worry about jamming or other such problems; likewise, it insures that on the other side of the machine the guide element—and, hence, the end of the wire—leaves the point in a precisely defined axial exit position, and that following each passage it finds, with great reliability, the precise height of the guide channel which is intended for it.

When useful and appropriate, a stop switch can be placed in the movement path of the guide element or of the slide block. This stop switch turns off the rotation of the transfer bar after the end of the winding process, so that an inappropriate coiling—caused by additional, undesired windings—can be avoided with certainty.

In order to avoid the possibility that the end of the wire might be released from the slide block following complete intake of the wire—or that the end of the wire might be drawn back into the wire enameling machine, or partially unwind itself, due to the tensile stress applied to the wire—the preferred further development of the invention provides for a clamping roller which stands in contact with the end region of a roller block. This clamping roller secures the end of the last coil of a wound up wire onto the roller block.

It may be remarked that an operable wire intake device of the type described in this invention can also be designed in such a way that the point arrangement on the slide block of the transfer bar and the guide element are both arranged so as to be stationary. To be certain, the arrangement with stationary points and a movable guide element is, as a general rule, especially preferred due to localized reasons.

Further advantageous characteristics of the invention will become apparent through the description which follows, in which an operational example of the invention will be described in greater detail with the help of a diagram.

BRIEF DESCRIPTION OF THE DRAWINGS

The various figures of the diagram show, in half-schematic representation.

DETAILED DESCRIPTION OF THE PREFERRED EMBODIMENT

Figure 1:
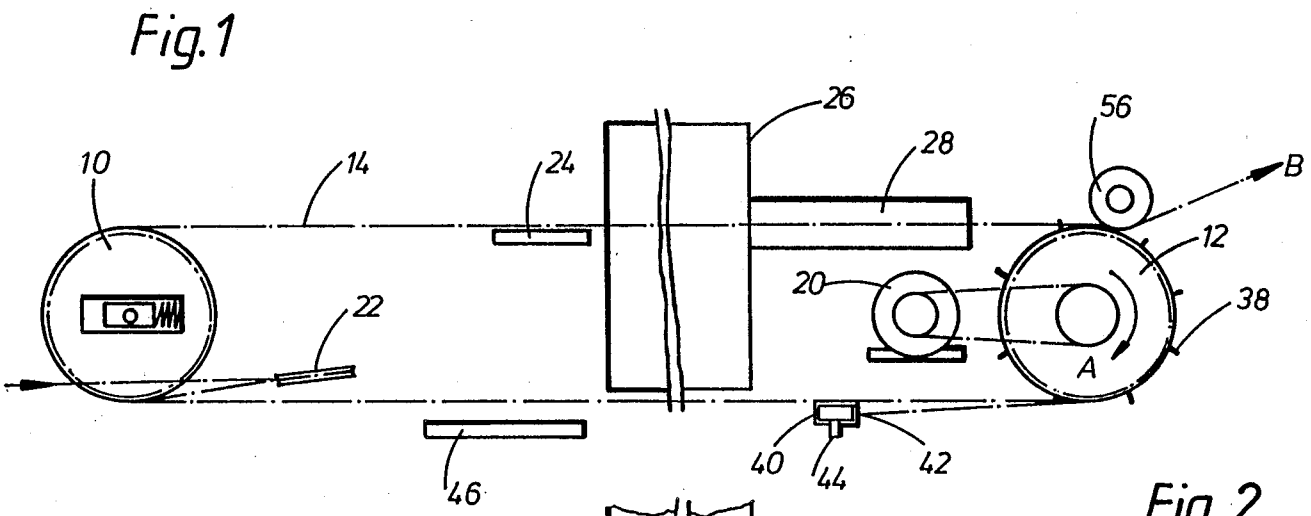
FIG. 1: a side view of a wire enameling machine with the wire intake device described by this invention.
Figure 2:
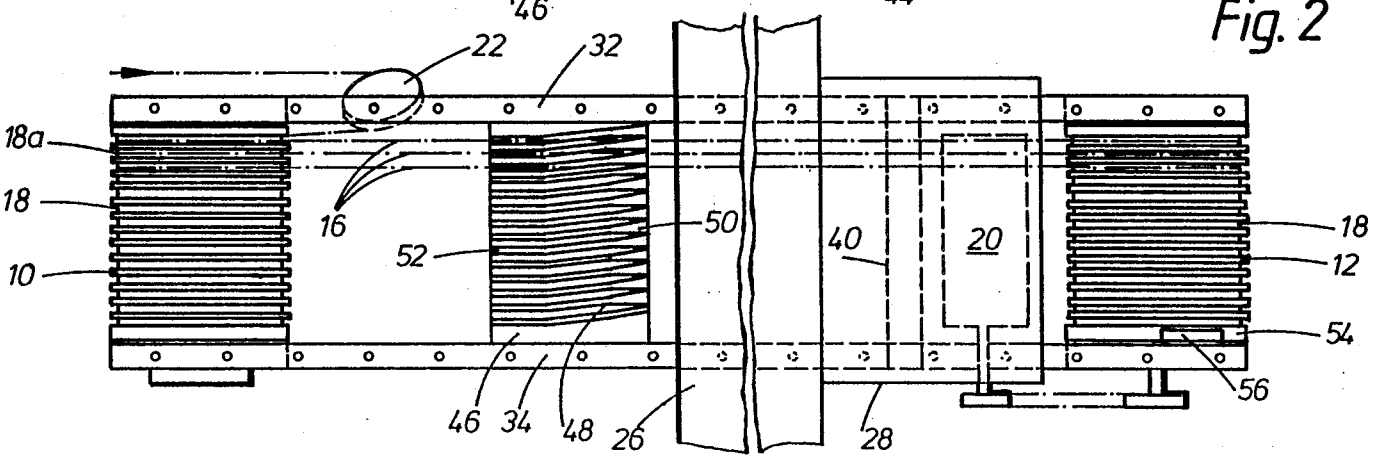
FIG. 2: a horizontal projection of the wire enameling machine per FIG. 1.

The wire enameling machine—which is presented only partially and very schematically in FIGS. 1 and 2—encompasses two co-axial roller blocks (10 and 12) which lie facing one another, and around which the wire to be enameled (14) is led in multiple layers or coils (16). The roller blocks (10 and 12) exhibit in an axial direction equally spaced guide channels (18) for the wire (14). The distance of the individual coils (16) from one another corresponds accordingly to the spacing of the individual guide channels (18) of the roller blocks (10 and 12). Roller block (10) is harnessed—in the direction of the connecting plane of both roller blocks (10 and 12)—away from roller block 12, so that the required tension is exerted on the wire (14) wound on the roller blocks, in order to hold the wire (14) taut. Roller block 12 can be propelled in the direction of arrow A by a drive motor (20).

The wire which is to be enameled (14) is pulled away from a wire-wound coil (which is not represented) by means of a wire pulling device (also not represented), and led over a deflection roller (22) to the outermost guide channel (**18*a*) of roller block (10**). The enameled wire that is finished in the processing stations of the wire enameling machine is, as represented by the B arrow, led away over suitable deflection rollers (which are not represented in further detail) and wound onto an enameled wire winding device (which is also not represented in further detail).

The wire that is wound in multiple coils (16) upon the roller blocks (10 and 12) runs—in multiple passages corresponding to the number of coils—through the various processing stations of the wire enameling machine, namely, and in particular: the enamel application device (24), the stove (26), and the drying and hardening device (28)—until the required enamel coating thickness is achieved.

In the event that multiple wires (14) must be simultaneously processed (in a manner not represented in further detail), then these wires will be led simultaneously and parallel to neighboring channels (18) via several deflection rollers (22) that are arranged beside one another in a staggered fashion. The number of passages of the multiple wires through the individual processing stations corresponds herewith to the relationship of the number of channels to the number of wires.

Figure 3:
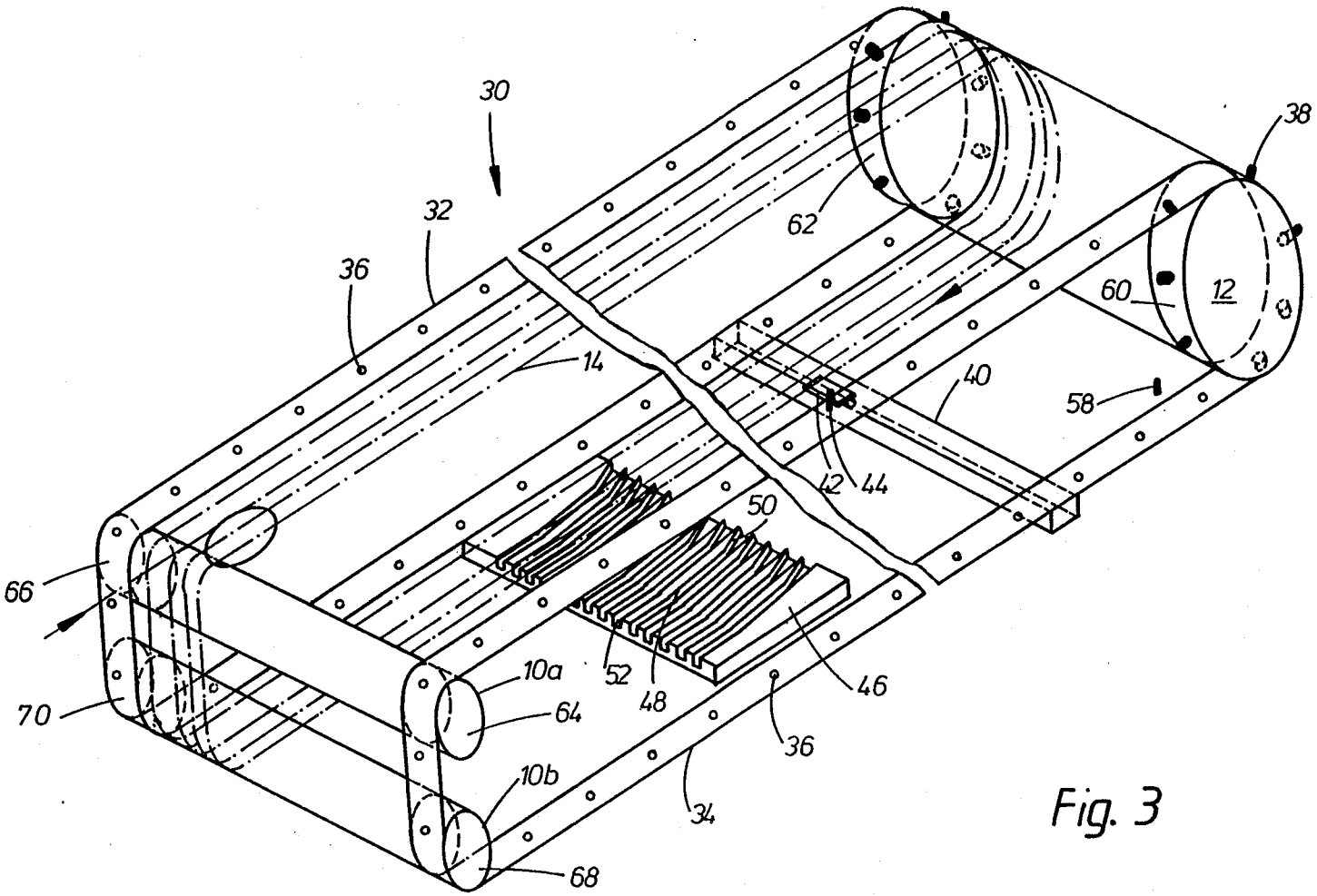
FIG. 3: a perspective view of the wire intake device per FIGS. 1 and 2.

In this connection one should note that in FIG. 3, rather than a single roller block (10) with a large diameter, two separate roller blocks (10*a* and 10*b*) with smaller diameters, positioned one atop the other, are represented; both arrangements should be regarded, however, as completely equal in value.

The wire intake device that is collectively labelled with the reference number (30) in FIG. 3 consists of two carrying straps (32 and 34) made of suitable heat-proof material, which are led, rotating, via the axial end regions of the roller blocks (10*a*, 10*b* 12) and which exhibit perforations (36), which operate in a drive-like manner with corresponding, pin-shaped projections (38) that stand on the perimeter of both ends of roller block (12) radiating toward the outside, so that when roller block (12) is propelled by means of the drive motor (20) the carrying straps (32 and 34) are reliably driven together.

On the outer side of the carrying straps (32 and 34) a transfer bar (40)—positioned crosswise to the carrying straps' direction of movement, and hence parallel to the roller blocks' axis of rotation—is fastened in a detachable manner. This transfer bar (40) carries a slide block (42) which can move in a longitudinal direction from the transfer bar (40), that is, parallel to the axis of rotation of the roller blocks. The slide block (42) exhibits a device (not represented in greater detail) to secure the end of the wire (14), with which the end of the wire is, for instance, clamped to the slide block. In the event that the ends of several wires need to be fastened simultaneously onto the slide block (42), this slide block exhibits multiple fastening devices which are spaced among one another along the slide block's (42) direction of displacement in accordance with the spacing of the individual wire coils previously described. In response to a displacement of the slide block (42) within the transfer bar (40), a frictional force counteracts which is at least sufficient to prevent an unforeseen and/or undesired displacement of the slide block (42) relative to the transfer bar (40).

A projecting pilot (44) which juts out below is fastened to the lower side of the slide block (42), as represented in FIGS. 1 and 3, which pilot (44) comes into contact with a point arrangement (46) upon rotation of the transfer bar (40).

With reference to the wire intake device (30), the point arrangement (46) is stationary and exhibits a number of guide channels (48)—which correspond to the number of guide channels (18) of roller blocks (10*a*, 10*b* and 12)—and which extend in approximately the same direction as the wire; however, they do run at somewhat of an angle, so that the pilot (44) which runs in one of the guide channels (48) will experience an axial displacement in the direction of the roller blocks' axis by running through such a guide channel (48). In so doing, the axial degree of this displacement corresponds to the spacing of the individual guide channels (18) on roller blocks (10*a*, 10*b* or 12). Such a guide channel (48) exhibits a funnel-shaped self-widening entry region (50) and, across from the entry region (50), a narrower exit region (52), at which exit region (52) the width of the guide channels (48) is only negligibly larger than the diameter of the pilot (44). The exit regions (52) of the guide channels (48) are positioned in an axial direction precisely on the heighth of the guide channels (18) of roller block (10 or 10*b*) that have been allocated to them, while the entry regions (50) are positioned in an axial direction precisely on the heighth of the guide channels (18) of roller block (12) that have been allocated to them. The configuration just described insures that the pilot (44), which runs out from the point arrangement (46) with the end of the wire fastened to it, is positioned precisely on the heighth of the guide channel (18) allocated to it at the moment, and that even then, should the position of the slide block (42) relative to the transfer bar (40) be negligibly displaced during a rotation, the pilot (44) will be reliably led into the next corresponding guide channel (48) because of the funnel-shaped expansion of the entry area (50).

In order to bring about the intake of a wire, to begin with the slide block (42) must be brought—through a stop motion device that is not represented in further detail—into its defined starting position, and the end of the wire secured onto the fastening device of the slide block (42). Finally the roller block (12) is set in rotation by the drive motor (20) and the carrying straps (32 and 34) which are coupled with this roller block are consequently also placed in motion, in the course of doing which the transfer bar (40) is set in rotation. By this means the wire (14) is laid into the neighboring guide channels (18), in the course of doing which the pilot (44) is brought, upon each rotation of the transfer bar (40), into contact with the point arrangement (46), and in doing so at any given time is displaced by the space of two neighboring guide channels, until the wire has been completely pulled or wound onto the roller blocks. As can be seen from FIGS. 1 and 2, the last tier of the intaken wire is led onto the lateral flange (54) of roller block (12), in the course of doing which a movably positioned, prestressed clamping roller (56) squeezes the end region of the coiled wire between itself and the flange (54), in order to prevent the end of the wire—upon its disengagement from the slide block (42)—from being drawn back into the wire enameling machine because of the tension applied to the wire.

As soon as the slide block (42) reaches the end position which lies across from its starting position—and, consequently, the wire is completely wound over the roller blocks; its end region held taut over the flange (54); and it is securely fastened here by means of the clamping roller (56)—the pilot (44) of the slide block (42) runs against the actuating arm (58) of a stop switch (which is otherwise not represented in greater detail), by means of which the propulsion of the transfer bar (40) is interrupted and this, together with the slide block

(42) and the end of the wire, comes to a standstill, so that the end of the wire can now be released from the slide block (42). Finally, prior to the initial operation of the wire enameling machine, the end of the wire is led to the enameled wire winding device (not represented) and the transfer bar (40) is separated from the carrying straps (32 and 34).

It should be understood that when the automatically operated wire intake device described by this invention is used, the individual processing stations of the wire enameling machine must be built in such a way that a passage of the transfer bar (42), together with the slide block (40), is possible. As a general rule, however, this presents no problems. In particular, the enamel application devices (24) that are nozzle-shaped or made from impregnated felt-parts can be constructed within the wire tier so as to be separable, and—for the purpose of drawing the wire in—a part of these enamel application devices may be lifted up or taken away.

Rather than separating the transfer bar (40) from the carrying straps (32 and 34) after the wire intake process, an alternative provision would allow the outer roller parts (60 to 70)—which convey the carrying straps (32 and 34)—to be turned independently of the roller blocks (10*a*, 10*b* and 12) to which they belong; and the roller parts (60 and 62) of the drivable roller block (12) to be coupled in a drive-like fashion with roller block (12) for the purpose of driving the transfer bar (40). In this case, following the intake of wire the transfer bar (40) is left in a position outside the processing stations of the wire enameling machine where it will not interfere, and roller parts (60 and 62) are uncoupled from roller block (12).

Should a number of wires be pulled through simultaneously in the shape of a harp, rather than a single wire (14), then, as indicated above, a slide block (42) provided with a corresponding number of fastening devices and a correspondingly altered point arrangement (46) should be used, by which the axial displacement of the slide block, upon each rotation, amounts to a multiple of the wire spacing—or the distance between neighboring guide channels—which corresponds to the number of wires.

We claim:

1. A wire intake device for a wire enameling machine in which wire that is to be coated and which is pulled continuously by an unwinding mechanism, is wound several times around a minimum of two roller blocks that stand at a distance from one another parallel to the axes thereof, passes through the processing stations of the wire enameling machine by rotating around these roller blocks a number of times, and it finally led away from the roller block structure, said wire intake device comprising:

a transfer bar, having two ends, which is rotatable around the roller blocks parallel to their axes;

a slide block which is displaceable along the transfer bar;

said slide block has a device for fastening at least one wire end;

said slide block has a guide element which extends crosswise of said transfer bar; and a stationary point arrangement is positioned parallel to the transfer bar the guide element being displaceable in an axial direction by the point arrangement upon each rotation around the roller block structure, which corresponds to a desired axial displacement of two neighboring coils of the wire on the roller block structure.

2. A wire intake device as claimed in claim 1, in which the transfer bar is detachably fastened to the carriers.

3. A wire intake device as claimed in claim 1, the slide block being detachably fastened to the transfer bar.

4. A wire intake device as claimed in claim 1, an actuating element of a stop switch being positioned in the movement path of the guide element or of the slide block, the stop switch being connected to end the rotation of the transfer bar after completion of the winding process.

5. A wire intake device as claimed in claim 1, comprising a clamping roller standing in contact with an end region of a roller block for fastening an end of the last coil to the roller block when the wire is completely wound onto the roller block structure.

6. A wire intake device as claimed in claim 1, having two continuous carriers are rotatable around the roller blocks, and which are positioned on both sides of the wire's winding region and carry the ends of the transfer bar.

7. A wire intake device as claimed in claim 6, in which the carriers have the form of a tape having perforations positionable for cooperation for the purpose of propulsion, with projections on at least one of the roller blocks.

8. A wire intake device as claimed in claim 6, in which the carriers are drivable by at least one of the roller blocks.

9. A wire intake device as claimed in claim 8, in which the carriers are rotatable on rollers, which are coaxial with the roller blocks, and of which at least one is displaceable by at least one of the roller blocks.

10. A wire intake device as claimed in claim 1, in which the point arrangement is replaceable.

11. A wire intake device as claimed in claim 1 or 10, in which the point arrangement has a number of guide surfaces corresponding to the number of coils of a wire on the roller block structure for contact with the guide element of the slide block, which guide surfaces are arranged lying beside one another in an axial direction and are inclined with respect to the center plane that connects the roller blocks.

12. A wire intake device as claimed in claim 11, an actuating element of a stop switch being positioned in the movement path of the guide element or of the slide block, the stop switch being connected to end the rotation of the transfer bar after completion of the winding process.

13. A wire intake device as claimed in claim 11, in which the guide surfaces of the point arrangement, viewed from the guide element's direction of movement, define a funnel-shaped, tapered entry region for the guide element and an exit area having a dimension in the axial direction corresponding to that of the guide element.

14. A wire intake device as claimed in claim 13, an actuating element of a stop switch being positioned in the movement path of the guide element or of the slide block, the stop switch being connected to end the rotation of the transfer bar after completion of the winding process.

* * * * *